US009478897B2

(12) United States Patent
Kashiwada et al.

(10) Patent No.: US 9,478,897 B2
(45) Date of Patent: Oct. 25, 2016

(54) WATERPROOF CONNECTOR

(71) Applicant: SUMITOMO WIRING SYSTEMS, LTD., Yokkaichi, Mie (JP)

(72) Inventors: Tomokazu Kashiwada, Yokkaichi (JP); Masafumi Uno, Yokkaichi (JP); Kiyotaka Itsuki, Yokkaichi (JP)

(73) Assignee: SUMITOMO WIRING SYSTEMS, LTD., Yokkaichi (JP)

( * ) Notice: Subject to any disclaimer, the term of this patent is extended or adjusted under 35 U.S.C. 154(b) by 4 days.

(21) Appl. No.: 14/626,078

(22) Filed: Feb. 19, 2015

(65) Prior Publication Data

US 2015/0244100 A1 Aug. 27, 2015

(30) Foreign Application Priority Data

Feb. 27, 2014 (JP) ..... 2014-036283

(51) Int. Cl.
*H01R 13/52* (2006.01)

(52) U.S. Cl.
CPC ..... *H01R 13/5202* (2013.01); *H01R 13/5219* (2013.01)

(58) Field of Classification Search
CPC ..... H01R 13/5202; H01R 13/5219
USPC ..... 439/556, 201, 271, 521, 675, 184
See application file for complete search history.

(56) References Cited

U.S. PATENT DOCUMENTS 4,753,604 A * 6/1988 Wheeler ..... H01R 13/523 439/271
6,910,910 B2 * 6/2005 Cairns ..... G02B 6/3816 174/13
7,794,254 B2 * 9/2010 Marklove ..... H01R 13/521 439/271
7,959,454 B2 * 6/2011 Ramasubramanian H01R 13/03 439/201
8,267,707 B2 * 9/2012 Rogers ..... H01R 13/52 439/271
2014/0024266 A1 * 1/2014 Kashiwada ..... H01R 13/6315 439/686
2014/0051286 A1 * 2/2014 Itsuki ..... H01R 13/533 439/587
2015/0244100 A1 * 8/2015 Kashiwada ..... H01R 13/5202 439/556
2015/0244103 A1 * 8/2015 Kashiwada ..... H01R 13/5213 439/272
2015/0288083 A1 * 10/2015 Kashiwada ..... H01R 4/38 439/247
2015/0333428 A1 * 11/2015 Kashiwada ..... H01R 13/5202 439/845

FOREIGN PATENT DOCUMENTS

JP 2013-232369 11/2013

* cited by examiner

*Primary Examiner* — Abdullah Riyami
*Assistant Examiner* — Nelson R Burgos-Guntin
(74) *Attorney, Agent, or Firm* — Gerald E. Hespos; Michael J. Porco; Matthew T. Hespos

(57) ABSTRACT

A waterproof connector (10) to be mounted on a case (90) of a device includes a housing (20) which includes a fitting (21) fittable into an opening (91) provided on the case (90), an annular seal ring (60) that provides watertightness between the inner peripheral surface of the opening (91) of the case (90) and the fitting (21) and a mounting recess (23) into which the seal ring (60) is to be fit. The mounting recess (23) is formed by mounting a separate front member (70) having a larger cross-section than a cross-sectionally small portion (29) provided at a front end part of the fitting (21) on the cross-sectionally small portion (29).

5 Claims, 5 Drawing Sheets

WATERPROOF CONNECTOR

BACKGROUND

1. Field of the Invention

The invention relates to a fluid proof connector and (specifically a waterproof connector.

2. Brief Description of the Related Art

Japanese Unexamined Patent Publication No. 2013-232369 discloses a waterproof connector to be mounted on a case of a device, such as an inverter. This connector includes a tubular housing that can fit into a mounting hole on a case. An annular seal is mounted on the outer peripheral surface of the housing for providing watertightness between the inner peripheral surface of the mounting hole and the outer peripheral surface of the housing. The seal is fit into a mounting recess recessed over the entire circumference on the outer peripheral surface of the housing so as not to come off the housing.

The mounting recess is formed simultaneously with the housing by a mold that is opened in a radial direction when the housing is molded of resin. However, a mounting recess that is by opening the molding mold in the radial direction has a parting line of the mold crossing the mounting recess and sealing performance of a seal may be reduced by burrs produced along the parting line. Further, a processing work such as the removal of the burrs is necessary to ensure sealing performance of the seal.

An object of the invention is to ensure sealing performance of a seal without processing work after molding.

SUMMARY OF THE INVENTION

The invention relates to a waterproof connector that is to be mounted on a mating member and includes a housing with a fitting portion that can fit into an opening on the mating member. An annular seal is fit into a fitting recess of the fitting portion to provide watertightness between the inner peripheral surface of the opening and the fitting portion. The mounting recess is formed by mounting a separate cross-sectionally large front member onto a cross-sectionally small portion provided at a front part of the fitting portion in a fitting direction on the cross-sectionally small portion.

The mounting recess can be formed by molding the cross-sectionally small portion using a mold that is opened in the fitting direction and mounting the front member on this cross-sectionally small portion. Thus, a parting line is formed on a surface of the mounting recess where the seal is to be mounted and can ensure sealing performance of the seal.

A separate front housing is assembled from a front side and is fittable to a mating connector in the mating member and may be mounted in the fitting portion loosely movably in a direction intersecting with the fitting direction of the fitting portion. Further, the front member locks the front housing from the front.

A retainer for locking the front housing is assembled with the fitting portion from the front and absorbs assembling tolerances between the mating connector. The front housing is loosely movably in the direction intersecting the fitting direction. However, if the retainer for locking the front housing is provided separately from the fitting portion, the number of parts increases and the structure of the fitting portion becomes complicated.

The front member that defines part of the mounting recess can double as a retainer for locking the front member from the front. Thus, the number of parts is maintained and the structure of the fitting portion is simplified.

The cross-sectionally small portion may define a tube that can receive the front is housing fittable from the front.

At least one locking hole may penetrate the cross-sectionally small portion from the inside to the outside and may be configured to fix the front member to the cross-sectionally small portion by fitting at least one resilient locking piece on the front member into the locking hole. Thus, the locking hole can be formed.

DETAILED DESCRIPTION

A fluid- or waterproof connector in accordance with an embodiment of the invention is identified by the numeral 10 in FIGS. 1 to 5. The waterproof connector 10 is to be mounted into an opening 91 in a case (an example of a "mating member") 90 of a device such as an inverter to be installed in a vehicle.

Figure 2:
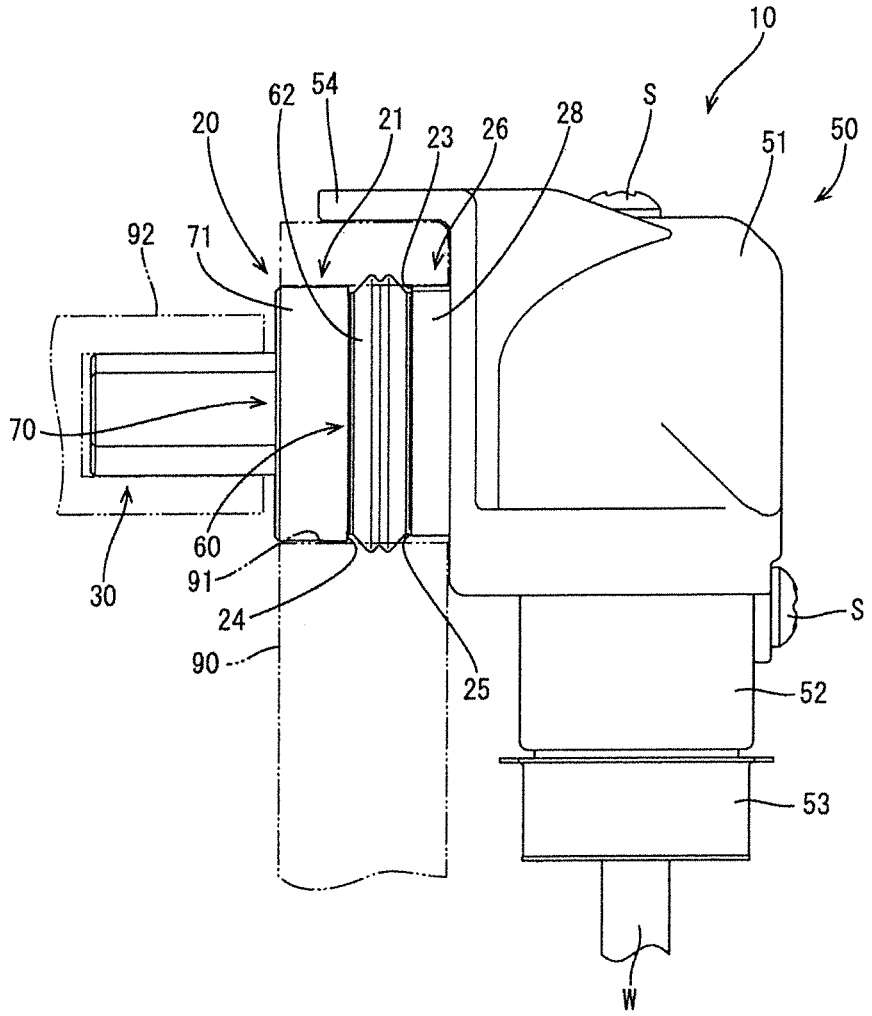
FIG. 2 is a side view of the waterproof connector.
Figure 3:
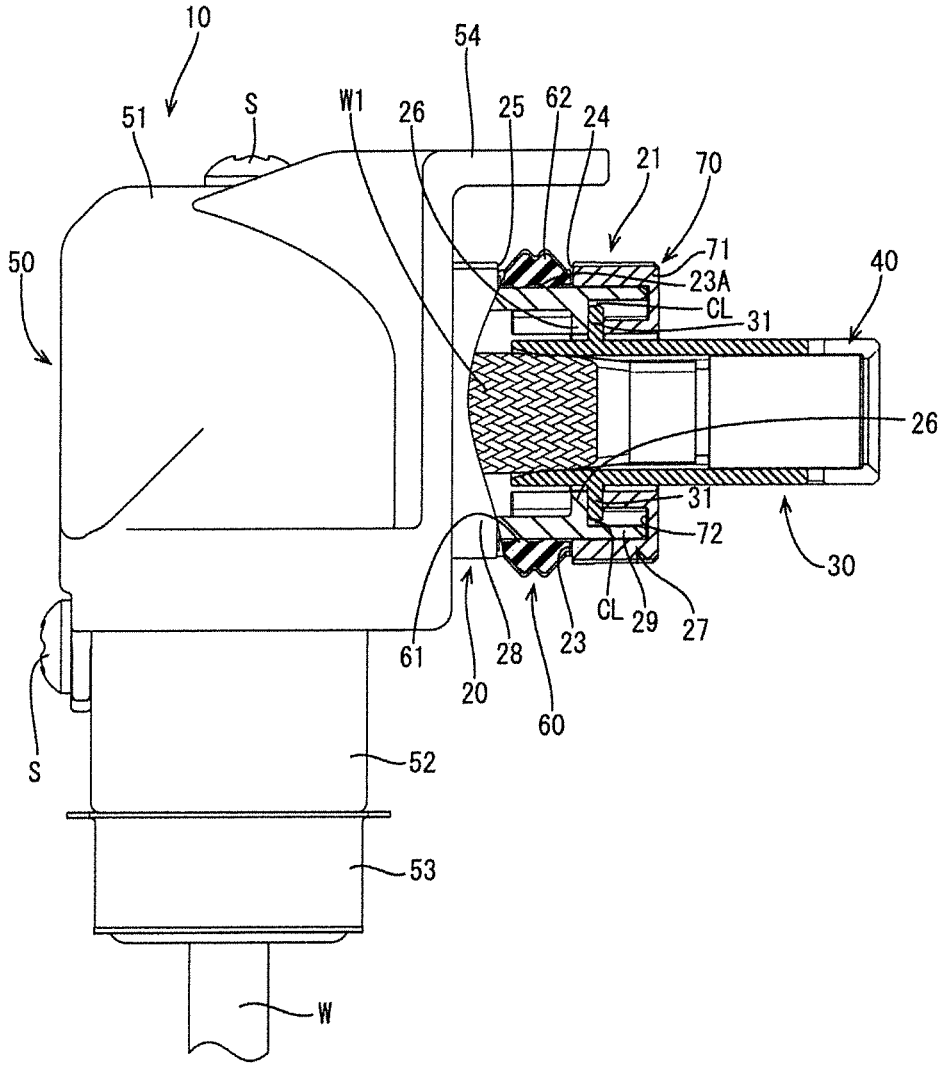
FIG. 3 is a side view partly in section along A-A of FIG. 1.

The waterproof connector 10 includes a housing 20 that is L-shaped in a side view, as shown in FIGS. 2 and 3. The housing 20 has a fitting 21 that can fit into the opening 91 of the case 90. A front housing 30 is to be mounted into the fitting 21 from the front. Terminals 40 are accommodated into the front housing 30 and a shield shell 50 covers a rear part of the housing 20.

Figure 4:
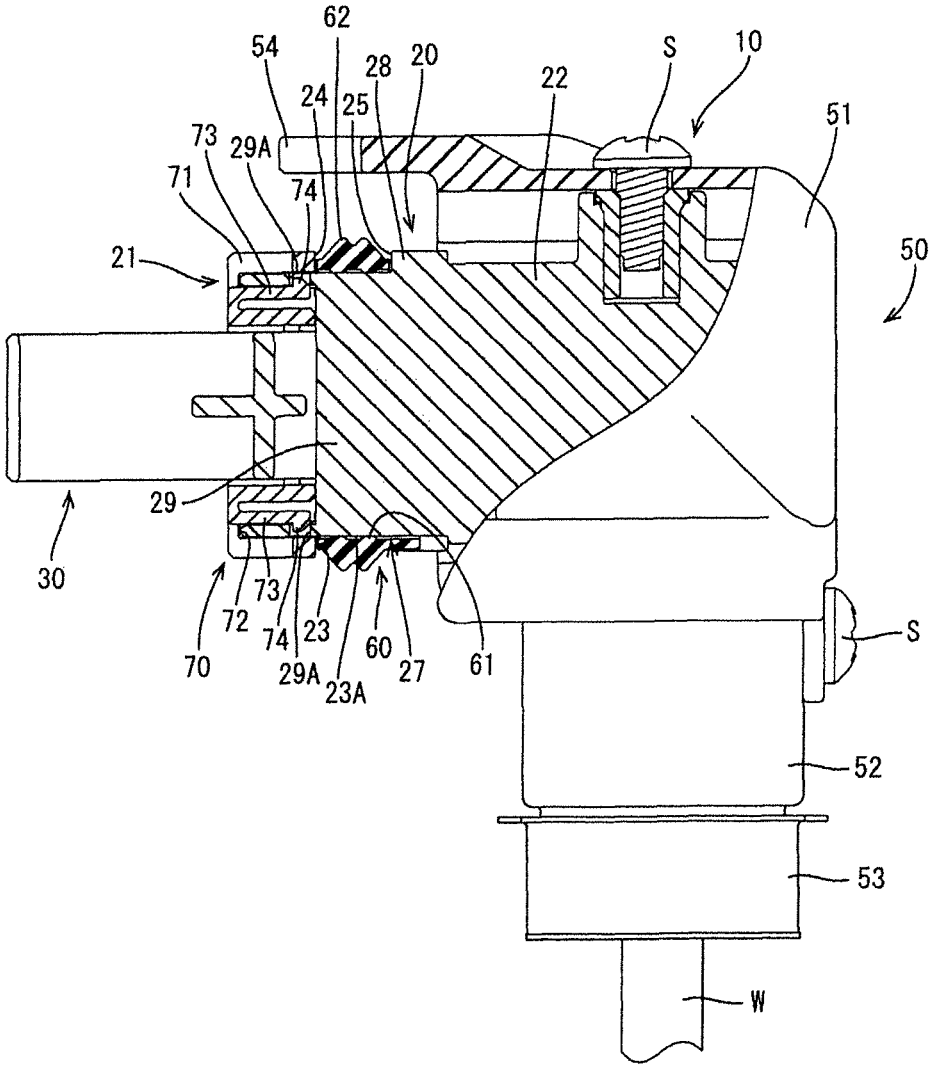
FIG. 4 is a side view partly in section along B-B of FIG. 1.
Figure 5:
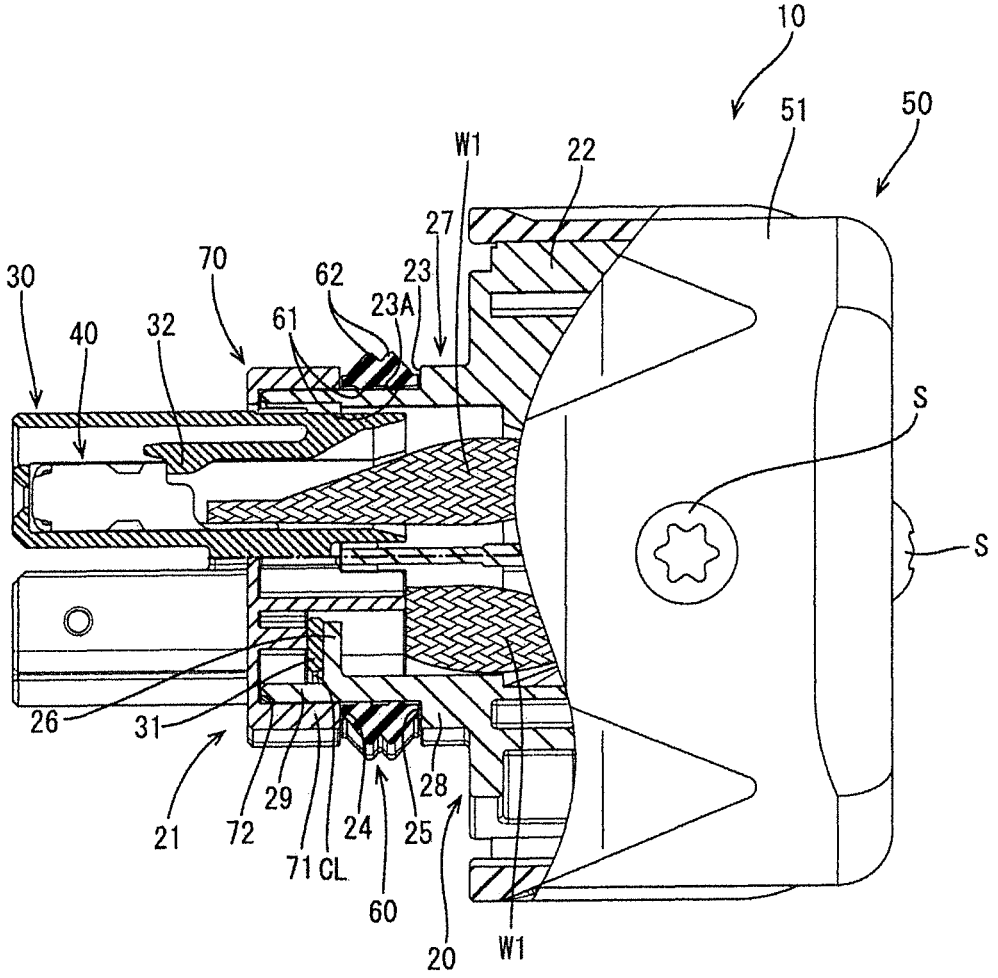
FIG. 5 is a top view partly in section along C-C of FIG. 1.

The housing 20 is formed so that the fitting 21 projects forward from the front surface of a block-like housing main body 22, as shown in FIGS. 4 and 5.

Wires W are introduced into the housing main body 22 of the housing 20 from below, and a shield layer comprising flexible braided conductors W compressed in a front-back direction are connected to ends of the wires W introduced into the housing 20.

As shown in FIGS. 2 to 5, the shield shell 50 is made of metal and is formed by assembling a lower shell 52 and an upper shell 51 on the housing main body 22. The lower shell 52 is formed into a tubular shape covering a part of the housing main body 22 into which the wires W are introduced, over the entire periphery. An unillustrated braided wire for collectively covering the wires W is caulked and connected to a lower end of the lower shell 52 by a caulk ring 53.

The upper shell 51 is formed into a box shape covering an upper part of the housing main body 22 from behind. The shield shell 50 is formed by assembling the upper shell 51 from behind after the lower shell 52 is assembled with the housing main body 22 from below. Further, the lower shell 52 and the upper shell 51 are fixed to the housing main body 22 by mounting screws S tightened into the upper surface and a lower part of the rear surface of the upper shell 51.

A fixing portion 54 extends forward on the front edge of the upper end of the upper shell 51, and the waterproof connector 10 is mounted on the case 90 by fixing the fixing portion 54 to the case 90 of the device by a fixing member (not shown), such as a bolt.

Figure 1:
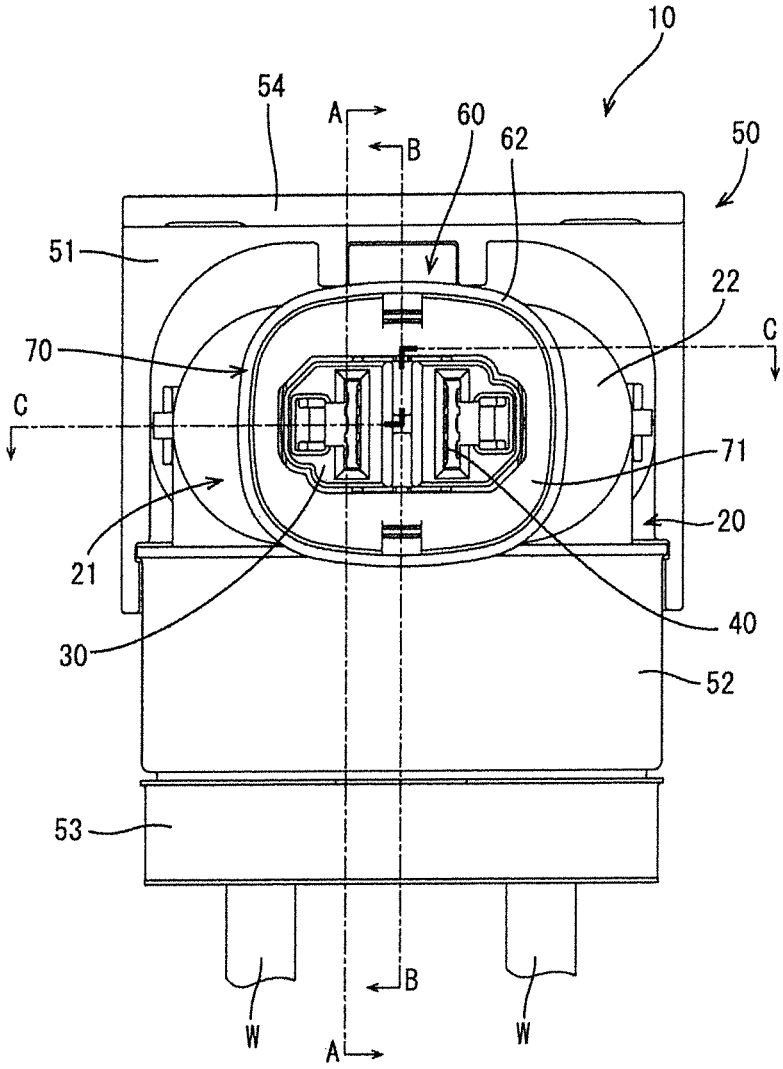
FIG. 1 is a front view of a waterproof connector.

As shown in FIG. 1, the fitting 21 is substantially cylindrical and a mounting recess 23 is provided on the outer peripheral surface of the fitting 21 for receiving a seal ring 60. The mounting recess 23 is provided over the entire circumference on the outer peripheral surface of the fitting 21.

The seal ring 60 is annular and inner peripheral lips 61 are formed side by side in the front-back direction on the inner peripheral surface of the seal ring 60, as shown in FIGS. 3 to 5, for closely contacting a bottom wall 23A of the mounting recess 23 over the entire circumference. Further, outer peripheral lips 62 are formed side by side in the front-back direction on the outer peripheral surface of the seal ring 60 for closely contacting the inner peripheral surface of the opening 91 of the case 90 over the entire circumference.

When the fitting 21 is fit into the opening 91 of the case 90, the inner peripheral lips 61 of the seal ring 60 are held in close contact with the bottom wall 23A of the mounting recess 23 and the outer peripheral lips 62 are held in close contact with the inner peripheral surface of the opening 91 to provide watertightness between the inner peripheral surface of the opening 91 of the case 90 and the fitting 21.

The seal ring 60 is prevented from moving forward and backward by being locked from front by a front wall 24 of the mounting recess 23 and locked from behind by a rear wall 25 of the mounting recess 23 when the fitting 21 is fit into and separated from the opening 91 of the case 90.

The front housing 30 is mountable into the fitting 21 from the front. The front housing 30 has a smaller cross-section than an inner cross-section of the fitting 21 and is long in the front-back direction. When the front housing 30 is mounted at a proper position in the fitting 21, a front half of the front housing 30 projects forward from the front end of the fitting 21.

The female terminals 40 are accommodated in the front housing 30. The female terminals 40 are connected to ends of the braided conductors W1 and held in the front housing 30 by locking lances 32 in the front housing 30.

The front half of the front housing 30 is fit to a device connector 92 arranged in the case 90 when the fitting 21 is fitted into the opening 91 of the case 90. When the front housing 30 and the device connector 92 are fi, the female terminals 40 and unillustrated device-side terminals held in the device connector 92 are connected electrically.

As shown in FIGS. 3 and 5, a bulging portion 31 bulges out radially in vertical and lateral directions on the outer peripheral surface of the front housing 30. The bulging portion 31 can be accommodated into the fitting 21 from the front together with a rear part of the front housing 30.

A stopper plate 26 projects radially inward on an inner peripheral wall of the fitting 21 and is provided at the same position as the front wall 24 of the mounting recess 23. The bulging portion 31 accommodated into the fitting 21 contacts the stopper plate 26 from the front to prevent further backward movement of the bulging portion 31 so that the front housing 30 is arranged at the proper position in the fitting 21.

A clearance CL is defined between the inner peripheral wall of the fitting 21 and a bulging end of the bulging portion 31, as shown in FIGS. 3 and 5. The front housing 30 is freely movable in the vertical and lateral directions perpendicular to a fitting direction with respect to the fitting 21 in a range where this clearance CL is formed. This enables the front housing 30 to move freely in vertical and lateral directions in the fitting 21 even if a fitting position of the device connector 92 and the front housing 30 is deviated from a proper position with respect to the fitting position of the opening 91 of the case 90 and the fitting 21 due to manufacturing tolerances, assembling tolerances and the like. Thus, manufacturing tolerances and assembling tolerances can be absorbed and the device connector 92 and the front housing 30 can be fit properly.

As shown in FIGS. 3 to 5, the fitting 21 of the housing 20 is formed by mounting a separate front member 70 on a fitting main body 27 integrally provided on the front surface of the housing main body 22.

The fitting main body 27 projects forward from the front surface of the housing main body 22, and a front part of the fitting main body 27 defines a cross-sectionally small portion 29 that has a smaller cross-section than a cross-sectionally large portion 28 at a rear part of the fitting main body 27. That is, the fitting main body 27 has a smaller cross-section toward the front and is formed by a mold (not shown) that is opened in the front-back direction when the housing main body 22 is molded of resin. Further, the cross-sectionally small portion 29 and the cross-sectionally large portion 28 are connected via a step that constitutes the rear wall 25 of the mounting recess 23 and the cross-sectionally small portion 29 constitutes the bottom wall 23A of the mounting recess 23.

The front member 70 includes an annular retainer 71 through which the front housing 30 is inserted in the front-back direction and that is to be mounted on a front end of the cross-sectionally small portion 29. The retainer 71 has substantially the same external dimensions as the cross-sectionally large portion 28 of the fitting main body 27, and a fitting groove 72 is provided on a rear part of the retainer 71 for receiving a front opening edge of the cross-sectionally small portion 29 from behind. When the front member 70 is mounted on the fitting main body 27 from the front and the front opening edge of the cross-sectionally small portion 29 is fit into the fitting groove 72 from behind, an outer peripheral edge of the retainer 71 faces the step of the fitting main body 27 between the cross-sectionally small portion 29 and the cross-sectionally large portion 28 in the front-back direction to define the front wall 24 of the mounting recess 23. Further, when the front opening edge of the cross-sectionally small portion 29 is fit into the fitting groove 72 from behind, an inner peripheral edge of the retainer 71 is arranged before the bulging portion 31 of the front housing 30 and the bulging portion 31 is locked from the front to hold the front housing 30 so as not come out forward.

Specifically, when the front member 70 is mounted on the fitting main body 27, the mounting recess 23 of the fitting 21 is formed by an outer peripheral edge part of the cross-sectionally small portion 29, the step of the fitting main body 27 between the cross-sectionally small portion 29 and the cross-sectionally large portion 28 and the outer periphery of the retainer 71. Further, when the front member 70 is mounted on the fitting main body 27, the bulging portion 31 of the front housing 30 is locked from the front by the inner peripheral edge of the retainer 71 and the front housing 30 can be held and retained in the fitting 21 while being enabled to move vertically and laterally in the fitting 21.

Further, as shown in FIG. 4, two resilient locking pieces 73 are provided on upper and lower sides of the retainer 71 and are resiliently displaceable radially inward. A locking projection 74 is provided on the tip of each resilient locking piece 73 and projects radially out. On the other hand, locking holes 29A are formed at opposite upper and lower positions of the cross-sectionally small portion 29 and penetrate from the inside to the outside of the cross-sectionally small portion 29. The locking holes 29A are arranged before the mounting recess 23. When the front member 70 is mounted on the fitting main body 27, the locking holes 29A are closed from an outer side by the retainer 71 of the front wall 24 of the mounting recess 23. Further, the locking projections 74 of the resilient locking pieces 73 can fit into the locking holes 29 from an inner side. When the front member 70 is mounted on the fitting main body 27, the locking projections 74 of the resilient locking pieces 73 are fit into the locking holes 29A from the inner side and lock to the front inner surfaces of the locking holes 29A in the front-back direction so that the front member 70 is fixed to the fitting main body 27.

The locking holes 29A can be formed without making the bottom wall 23A, on which the seal ring 60 is to be mounted, uneven in the mounting recess 23 and without using a slide mold that is removed inwardly. Further, when the front member 70 is mounted on the fitting main body 27, the locking holes 29A are closed by the retainer 71 from the outer side. Therefore, disengagement of the locking projections 74 of the resilient locking pieces 73 from the locking holes 29A due to the contact of another member can be prevented.

The fitting 21 of the waterproof connector 10 is formed by initially mounting the seal ring 60 on the cross-sectionally small portion 29 of the fitting main body 27 before the front member 70 is mounted. The fitting main body 27 has a smaller cross-section toward the front from the cross-sectionally large portion 28 to the cross-sectionally small portion 29. Thus, the seal ring 60 can be fit easily on the outer peripheral surface of the cross-sectionally small portion 29 from the front.

The rear end surface of the seal ring 60 contacts the step between the cross-sectionally small portion 29 and the cross-sectionally large portion 28 (rear wall 25 of the mounting recess 23) when the seal ring 60 is at a proper position with respect to the cross-sectionally small portion 29. Thus, the seal ring 60 is prevented from moving any farther backward.

The front housing 30 is mounted into the fitting 21 from the front when the seal ring 60 is fit on the cross-sectionally small portion 29. In this mounting process, the bulging portion 31 of the front housing 30 contacts the stopper plate 26 in the fitting 21 from the front to complete the insertion of the front housing 30 into the fitting 21 with the front housing 30 arranged at the proper position in the fitting 21.

The front member 70 is mounted on the front end of the cross-sectionally small portion 29 from the front after the mounting of the front housing 30 is finished. More particularly, the front housing 30 is inserted into the retainer 71 from behind and the front end part of the cross-sectionally small portion 29 is fit into the fitting groove 72 of the retainer portion 71.

When the front end part of the cross-sectionally small portion 29 is fit into the fitting groove 72 from behind, the outer peripheral edge of the retainer 71 is arranged before the step of the fitting main body 27 between the cross-sectionally small portion 29 and the cross-sectionally large portion 28, whereby the mounting recess 23 in which the seal ring 60 is mounted is formed as shown in FIGS. 3 to 5.

If a fitting recess is molded simultaneously with a fitting, for example, by a mold that is opened in a radial direction, the fitting recess is formed with a parting line of the mold crossing the fitting recess and sealing performance of a seal ring tends to be reduced e.g. by burrs produced along the parting line. Further, a processing work after molding, such as the removal of burrs, is necessary to ensure sealing performance of the seal ring in the fitting recess in such a case.

However, according to this embodiment, the mounting recess 23 can be formed by molding the fitting main body 27 using the mold that is opened in the front-back direction, which is a fitting direction, and mounting the front member 70 on the front end part of the cross-sectionally small portion 29. This prevents a parting line from being formed on the mounting recess 23 into which the seal ring 60 is to be fit, and can ensure sealing performance of the seal ring 60 in the mounting recess 23.

Further, when the front opening edge of the cross-sectionally small portion 29 is fit into the fitting groove 72 from behind, the bulging portion 31 of the front housing 30 is locked from the front by the inner peripheral edge of the retainer 71 and the front housing 30 is held so as not to come out forward, as shown in FIGS. 3 and 5. That is, the retainer 71 (front wall 24 of the mounting recess 23) that prevents the seal ring 60 from coming out forward can double as a retaining portion for retaining the front housing 30 in the fitting 21 while enabling the front housing 30 to move vertically and laterally in the fitting 21. In this way, an increase in the number of parts can be prevented and the structure of the fitting 21 can be simplified as compared with the case of individually providing a retainer for retaining the seal ring 60 on the fitting 21 and a member for retaining the front housing 30.

When the retainer 71 reaches the proper position with respect to the cross-sectionally small portion 29, the locking projections 74 of the resilient locking pieces 73 of the retainer 71 are fit into the locking holes 29A of the cross-sectionally small portion 29 from the inner side and locked to the front inner surfaces of the locking holes 29A in the front-back direction as shown in FIG. 4. Thus, the front member 70 is fixed to the fitting main body 27 and the fitting portion 21 is formed.

Further, when the front member 70 is fixed to the fitting main body 27, the retainer 71 constituting the front wall 24 of the mounting recess 23 closes the locking holes 29 from the outer side and prevents disengagement of the locking projections 74 from the locking holes 29A due to contact of another member with the locking projections 74 of the resilient locking pieces 73 or the like.

As described above, for the waterproof connector 10 of this embodiment, the mounting recess 23 is formed by molding the fitting main body 27 using the molding mold that is opened in the front-back direction and mounting the front member 70 on the cross-sectionally small portion 29 of the fitting main body 27. Thus, sealing performance of the seal ring 60 in the mounting recess 23 can be ensured by preventing a parting line by the molding mold from being formed on the mounting recess 23.

Further, the retainer 71 (front wall 24 of the mounting recess 23) that prevents the seal ring 60 from coming out forward can double as the retaining portion for retaining the front housing 30. Thus, an increase in the number of parts can be prevented and the structure of the fitting 21 can be simplified as compared with the case of providing a retainer for retaining the seal ring 60 on the fitting 21 and a member for retaining the front housing 30.

Furthermore, the locking holes 29A are formed before the part of the cross-sectionally small portion 29 serving as the mounting recess 23 and these locking holes 29A are closed from the outer side when the front member 70 is mounted. Thus, the locking holes 29A can be formed without using a slide mold that is removed inwardly. When the waterproof connector 10 is completed, these locking holes 29A are closed to be able to prevent the contact of another member with the locking projections 74 of the resilient locking pieces 73.

The technology disclosed in this specification is not limited to the above described and illustrated embodiment. For example, the following embodiments are also included in a technical scope.

In the above embodiment, the waterproof connector 10 to be mounted into the opening 91 provided on the case 90 of the device is shown as an example. However, without limitation to this, the technology disclosed in this specification may be applied to a waterproof connector to be fitted into an opening provided on a mating connector.

In the above embodiment, the housing 20 is formed to be substantially L-shaped. However, without limitation to this, the housing may be formed to substantially extend straight in the front-back direction or have a bent configuration different from an L-shape.

In the above embodiment, the resilient locking pieces 73 are provided on the retainer 71 of the front member 70 and the front member 70 is fixed to the fitting portion main body 27 by fitting the resilient locking pieces 73 into the locking holes 29A of the small diameter portion 29. However, without limitation to this, the front member may be fixed to the fitting portion main body by providing resilient locking pieces on the tip of the small diameter portion and fitting these resilient locking piece into locking holes provided on the retainer portion.

REFERENCE SIGNS

10: waterproof connector
20: housing
21: fitting portion
23: mounting recess
29: small diameter portion
29A: locking hole
30: front housing
60: seal ring (seal member)
70: front member
73: resilient locking piece
90: case (mating member)
91: opening
93: device connector (mating connector)

What is claimed is:

1. A fluidproof connector to be mounted on a mating member, comprising:

a housing with a front end and a fitting adjacent the front end, the fitting being fittable into an opening on the mating member, the fitting including a cross-sectionally small portion adjacent the front end and a cross-sectionally large portion rearward of the cross-sectionally small portion, a forwardly facing rear wall extending from the cross-sectionally small portion to the cross-sectionally large portion;

a seal mounted around the cross-sectionally small portion at a position adjacent to the rear wall and rearward of the front end of the fitting; and a separate front member mounted over the cross-sectionally small portion and extending from the front end of the fitting to the seal so that the seal is retained in a mounting recess defined between the cross-sectionally large portion and the front member and so that an outer surface of the seal projects out beyond the cross-sectionally large portion of the fitting and the front member to provide fluidtightness between the opening of the mating member and the fitting.

2. The fluidproof connector of claim 1, further comprising a separate front housing mounted in the fitting loosely movably in a direction intersecting a fitting direction of the fitting into the mating member, the front housing being assembled from the front end of the fitting and being connectable to a mating connector in the mating member.

3. The fluidproof connector of claim 2, wherein the front housing is locked from the front by the front member.

4. The fluidproof connector of claim 2, wherein the cross-sectionally small portion has a tubular shape into which the front housing is inserted from the front.

5. The fluidproof connector of claim 4, wherein at least one locking hole penetrates the cross-sectionally small portion at a position between the front end and the seal, the locking hole being configured to fix the front member to the cross-sectionally small portion by fitting at least one resilient locking piece provided on the front member into the locking hole from an inner side.

* * * * *